United States Patent [19]

Fitzgerald

[11] 4,282,976

[45] Aug. 11, 1981

[54] DISPLAY HOLDER

[76] Inventor: Robert E. Fitzgerald, P.O. Box 100, Barrington, Ill. 60010

[21] Appl. No.: 103,335

[22] Filed: Dec. 13, 1979

[51] Int. Cl.[3] ..... A47F 5/02

[52] U.S. Cl. ..... 211/59.1; 211/163

[58] Field of Search ..... 211/59.1, 57.1, 54.1, 211/175, 205, 163, 181

[56] References Cited

U.S. PATENT DOCUMENTS

| | | | |
|---|---|---|---|
| 1,306,297 | 6/1919 | Auerochs | 211/59.1 X |
| 1,729,004 | 9/1929 | Miadowicz | 211/163 X |
| 3,076,557 | 2/1963 | Husted et al. | 211/196 |

FOREIGN PATENT DOCUMENTS

| | | | |
|---|---|---|---|
| 1129115 | 10/1968 | United Kingdom | 211/57.1 |

*Primary Examiner*—Roy D. Frazier
*Assistant Examiner*—Robert W. Gibson, Jr.
*Attorney, Agent, or Firm*—Edward C. Threedy

[57] ABSTRACT

A rotatable article storage and display holder having a number of hangers for the pre-packaged articles sought to be displayed. The holder includes a means of adjusting the hangers longitudinally throughout their length as well as through a vertical component relative to their attachment to a freely rotatable top, which in turn is supported on a vertical standard mounted upon a stabilizing base.

8 Claims, 3 Drawing Figures

DISPLAY HOLDER

SUMMARY OF THE INVENTION

In displaying pre-packaged articles it is advantageous to provide a so-called counter top display and holder. It is an object of this invention to provide such a counter top display and holder that is rotatable through 360° which supports a number of hangers that may be readily adjusted so as to accommodate various sizes and numbers of pre-packaged articles. The invention provides a number of hangers that are of sufficient rigidity to support the packages yet capable of being forcibly flexed out of their normal longitudinal plane so as to be adjustably mounted upon a rotatable top that in turn is supported on a vertical standard carried by a stabilizing base.

The hangers may be adjustably connected to the top of the display so as to project outwardly to either side therefrom in varying lengths.

GENERAL DESCRIPTION

The invention will be best understood by reference to the accompanying drawings which illustrate the preferred form of construction by which the objects of the invention are achieved and in which.

Figure 1:
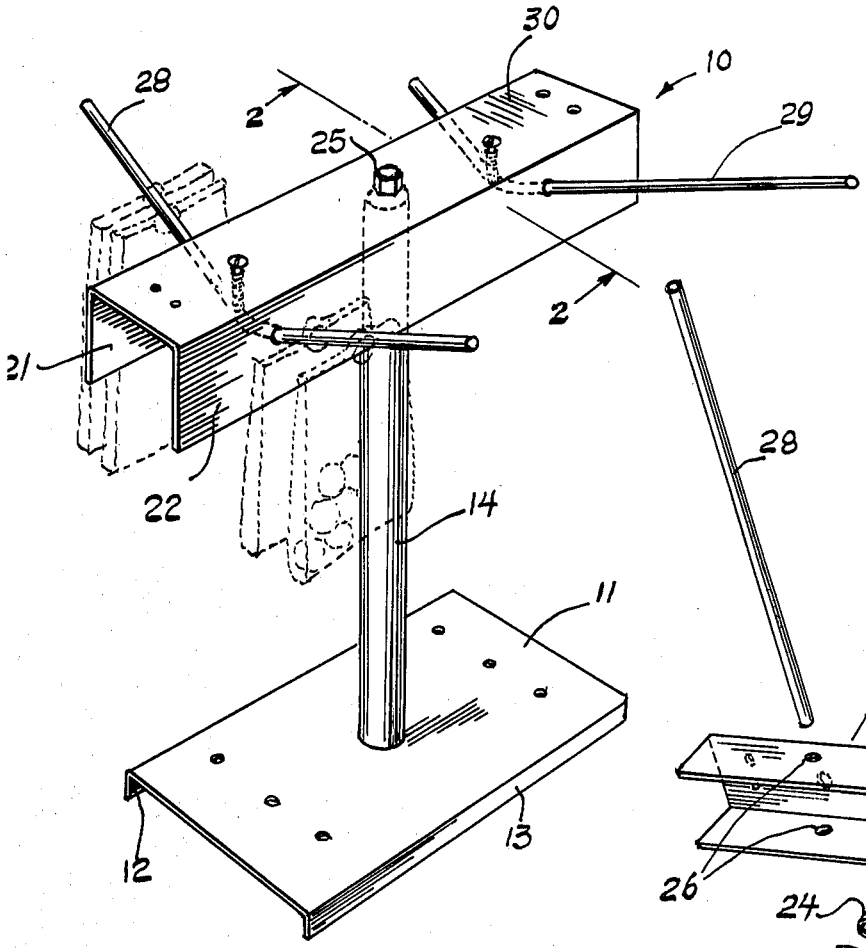
FIG. 1 is a perspective view of the display holder of this invention.
Figure 2:
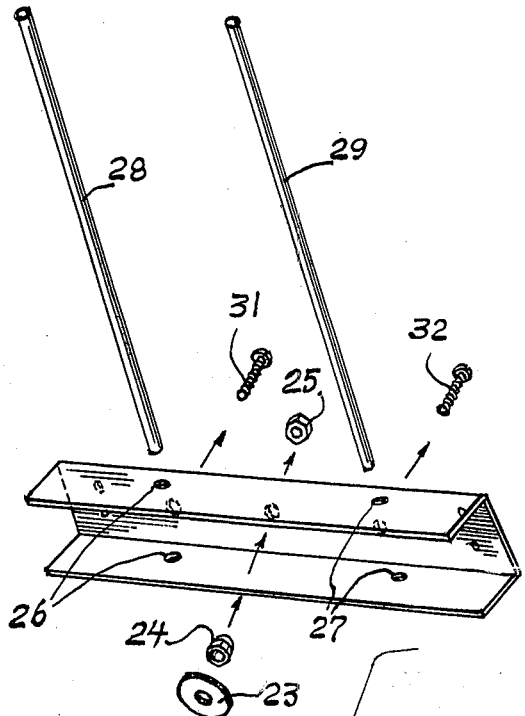
FIG. 2 is a side sectional view taken on line 2—2 of FIG. 1.
Figure 2:
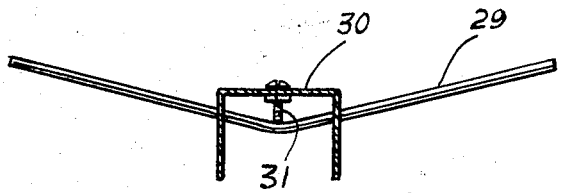
Figure 3:
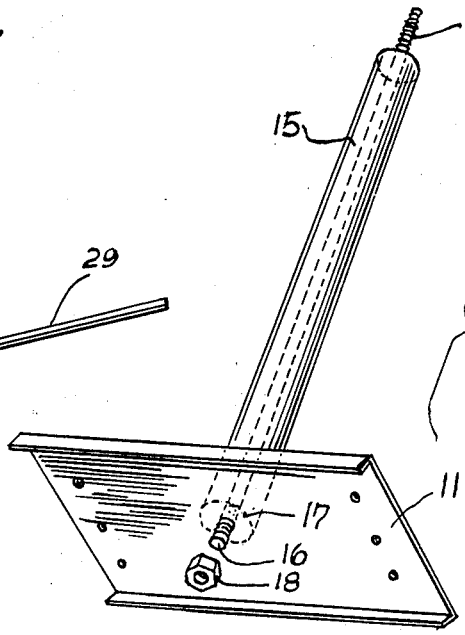
FIG. 3 is a perspective view of the parts of the invention in an exploded relation.

Referring to FIG. 1, there is illustrated a display holder 10 which includes a rectangularly-shaped base 11, the longitudinal edges of which provide supporting legs 12 and 13.

Mounted upon the base 11 is a hollow standard 14. Journalled through the standard 14 is a shaft 15, one end 16 of which projects through an opening 17 formed in the base 11. The end 16 is threaded so as to receive a connecting nut 18.

The opposite end 19 of the shaft 15 is adapted to project through an opening formed in a top plate 20. The top plate 20 is substantially U-shaped so as to provide depending legs 21 and 22. A suitable washer 23 and retaining nuts 24 and 25 are utilized to rotatably mount the top 20 onto the shaft 15 as well as the standard 14.

Formed in the legs 21 and 22 of the top 20 are a set of horizontally aligned openings 26 and 27.

Adapted to be projected through each of the set of openings 26 and 27 are a pair of hangers 28 and 29. The hangers 28 and 29 are preferably elongated rodlike members made from any memory possessing material which will provide sufficient rigidity to support pre-packaged articles hung thereon, while permitting forcible flexing out of their normal longitudinal plane.

The medial flat top plate 30 of the top 20 is provided with a pair of threaded openings which are in transverse alignment with the set of openings 26 and 27. Threaded through these openings are bolts 31 and 32.

When the hangers 28 and 29 are projected through their respective openings 26 and 27 the bolts 31 and 32 are threaded so as to cause their inner ends to bear upon that portion of the hangers 28 and 29 disposed between the legs 21 and 22, causing the same to flex out of their normal plane and out of the normal plane of alignment of the openings 26 and 27, a sufficient distance whereby they will be retained in place relative to the rotatable top 20. By the flexing of the hangers 28 and 29 the free portions of which extend beyond the legs 21 and 22 of the top 20 will be caused to be elevated in a vertical direction as seen in FIG. 1.

With a vertical displacement of the free ends of the hangers 28 and 29 pre-packaged articles can be suspended therefrom in a manner that will keep the same from occasionally becoming displaced.

It is also possible to vary the displacement of the hangers relative to the top as shown in FIG. 1 wherein hanger 29 has a larger portion of its length projecting outwardly of leg 22 while still being secured to the rotatable top. This affords a faster moving article to be carried by the display in a greater volume while still permitting variety of articles to be displayed.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A display holder for pre-packaged goods comprising (a) a substantially rectangularly-shaped base providing a flat platform, (b) a standard extending vertically from said platform of said base, (c) a top member rotatably mounted on the free end of said standard, (d) means for rotatably mounting said top member on said standard, (e) elongated hanger means projected through said top member so as to extend to either side thereof, (f) means provided by said top member for carrying said hanger means whereby said hanger means project laterally from said top member, and (g) means adjustably connecting said hanger means to said top member whereby their length of projection from said top member may be varied.

2. A display holder as defined by claim 1 wherein said hanger means comprise elongated rodlike memory possessing semi-rigid elements.

3. A display holder as defined by claim 1 wherein said means adjustably connecting said hanger means to said top member comprises bolts threaded through said top member transversely to the normal plane of said hanger means and having contact with said hanger means for bending the same out of their normal longitudinal plane whereby their free ends project outwardly and in a vertical inclined relation to said top member.

4. A display holder as defined by claim 3 wherein said hanger means comprise elongated rodlike memory possessing semi-rigid elements.

5. A display holder as defined by claim 1 wherein said top member comprises an elongated flat plate having depending, longitudinal arms extending parallel to said standard, and wherein said means provided by said top member for carrying said hanger means are aligned openings formed in said arms through which said hanger means project so as to be carried by said top member.

6. A display holder as defined by claim 5 wherein said hanger means comprise elongated rodlike memory possessing semi-rigid elements.

7. A display holder as defined by claim 5 wherein said means adjustably connecting said hanger means to said top member comprises bolts threaded through said top member transversely to the normal plane of said hanger means and having contact with said hanger means for bending the same out of their normal longitudinal plane whereby their free ends project outwardly and in a vertical inclined relation to said top member.

8. A display holder as defined by claim 4 wherein said top member comprises an elongated flat plate having depending longitudinal arms extending parallel to said standard, and wherein said means provided by said top member for carrying said hanger means are aligned openings formed in said arms through which said hanger means project so as to be carried by said top member.

* * * * *